US006217260B1

(12) United States Patent
He

(10) Patent No.: US 6,217,260 B1
(45) Date of Patent: Apr. 17, 2001

(54) DOWNHOLE REAMER WITH DOUBLE ACTING DUAL PISTON CYLINDER

(76) Inventor: Dexin He, No. 1408, Bldg. 6, Dong Wang Zhuang, Qinghua Donglu, Haidian District, Beijing (CN), 100083

( * ) Notice: Subject to any disclaimer, the term of this patent is extended or adjusted under 35 U.S.C. 154(b) by 0 days.

(21) Appl. No.: 09/198,544

(22) Filed: Nov. 24, 1998

(30) Foreign Application Priority Data

Jul. 10, 1998 (CN) ..... 98102841

(51) Int. Cl.[7] ..... E02D 5/44

(52) U.S. Cl. ..... 405/237; 405/244; 175/267; 92/65; 92/75

(58) Field of Search ..... 405/237, 244, 405/232, 229; 52/160; 175/267; 92/65, 75

(56) References Cited

U.S. PATENT DOCUMENTS 2,600,493 * 6/1952 Farris ..... 92/65

3,443,648 * 5/1969 Howard ..... 175/267

* cited by examiner

*Primary Examiner*—Eileen D. Lillis
*Assistant Examiner*—John Kreck
(74) *Attorney, Agent, or Firm*—Heller Ehrman White & McAuliffe

(57) ABSTRACT

An intelligent multi-functional hydraulic expanding apparatus includes a hydraulic expanding head, an automatic control hydraulic center, and a depth measuring system. The expanding head includes a hydraulic positioning device, an automatic hydraulic revolving device, a bi-directional cylinder uni-directional pulling type cylinder, and expanding arms that are rigidly connected. As the expanding apparatus adopts steel rope connection, the automatic reviving device performs transfer of torque, multi-arm expanding arms are installed in the same circular cross-section with displacement sensors, computer, and depth measuring system, the present invention provides a solution to the drag problem, increasing efficiency of construction of concrete piles for various foundations of buildings, bridges and obtain pressure angles and depth values so as to improve quality of the construction project.

8 Claims, 6 Drawing Sheets

DOWNHOLE REAMER WITH DOUBLE ACTING DUAL PISTON CYLINDER

TECHNICAL FIELD OF THE INVENTION

The present invention relates to an apparatus for grouting of reinforced concrete piles for buildings, bridges or various foundations, in particular, to a hydraulic expanding apparatus for the construction of piles of bridges, buildings, protection slopes, and high-pressure anchor struts, etc.

BACKGROUND OF THE INVENTION

As disclosed in Chinese Patent No. CN 2218768Y, the present expanding apparatus, such as a hydraulic aviate former for piles with multi-branch bearing plates, is a multi-branch bearing plate pile machine designed to increase its bearing capacity and tensile strength. With this machine, construction of a pile is completed by drilling a hole, expanding the hole, and pouring concrete into the holes. The multi-branch bearing plate hole expanding apparatus is a special equipment for forming the side cavities of the pile holes to be fulfilled with concrete, which is suitable not only for poured piles, but also for anchor struts. It is proven that the pile so built has the features of increased load bearing capacity and reduced amount of concrete poured into. However, the extended tube of this expanding apparatus is rigidly coupled by connecting steel pipes one segment after another and is lifted and dropped unto a determined depth of a hole by a crane to perform an expanding operation. After one expanding operation is completed, the bow pressing arm is retracted and revolved to the next position with the aid of a thinner steel tube extending through a hole on the steel arm and expanding operation starts again.

To complete expanding of an entire cavity, the steel arms have to be revolved 8–9 times. The reason to have a rigid coupling of steel pipes is to achieve these functions:

(a) torque transmission, (b) tension transfer, and (c) measurement of the depth of the working device in a hole.

If the expanding operation takes place at the bottom of a hole of 40 m–50 m deep, an extended steel tube has a diameter of 280 mm, a wall thickness of 14 mm, and a length of 40 m–50 m and the working device has to be lowered down into the hole. The extended steel tube weighs to tens of tons, which makes vertical movement of the long extended tube difficult, resulting in labor and time wasting. Furthermore, when an extended tube is in a hole at tens of meters deep, there is likely offset vertically, which may cause the steel tube stuck in the hole. Especially when expanding, a pressure force of hundreds of tons is applied to both sides of the hole, so the steel tube inclines towards one direction if the angle of the pressure force is applied offset, resulting in a side force increased by tens of times. As a result, the connecting bolt and shaft pin may be broken so that the expanding device may fall down into the hole. In addition, the prior art apparatus may not accurately measure the depth the tube drops down and thus, the layer underground can not be located accurately. This inaccurate location leads to error on the load bearing capacity and creates poor piles.

Besides, there is an outer tube outside the bow pressing arm, which not only increases the weight of the apparatus, but also brings soil with it while the bow pressing arm is retracted. It is even worse when the expanding operation is performed at a layer of sand and stones since stones brought into the tube may stick the bow pressing arm from being retracted. In this case, it is impossible to lift up the apparatus from the hole as the bow pressing arm cannot be retracted to its normal position. In addition, prior art expanding apparatus neither detects the status of the soil being expanded, nor tests the expanding operation. Therefore, concrete pouring processing in construction of a pile has to be stopped once collapse happens, thus, what is needed is an extending apparatus that may be smoothly moved in a hole to complete expanding process.

SUMMARY OF THE INVENTION

An objective of the present invention is to provide an extending apparatus with flexible coupling for tension transfer. Preferably, a flexible steel rope is used as coupling means. Also, an automatic hydraulic revolving device is provided for transfer of torque; a depth measuring device and a drag cleaning device at the bottom of the hydraulic cylinder are provided to clean drag; and an expanding device with multi-arms at the same circular cross-section is provided to increase the stability of the operation and for central positioning.

Another objective of the present invention is to measure pressure values and recognize the layer of soil in expanding process. With aid of a displacement sensor, pressure value of each arm, pressed angles, and values of the expanding device revolving angle are accurately detected.

To implement the present invention, the fully intelligent multi-functional expanding apparatus includes a hydraulic expanding device, an automatically controlled hydraulic center, and a measuring system. The hydraulic expanding device includes a hydraulic positioning device, a hydraulic revolving device, a unidirectional pulling type bi-directional cylinder, and an expanding arms, which are rigidly connected one by one.

The hydraulic positioning device has a shaft pin connected to a coupler, a steel rope connected to the shaft pin, and an external tube connected to the coupler. The revolving positioning device is fixed on the bottom of the positioning device by an external positioning tube, a hydraulic positioning block, and a central positioning block; wherein three hydraulic cylinders are fixed on three hydraulic positioning blocks respectively, and a ladder-shaped block is coupled to the piston rod of each hydraulic cylinder. When the cylinders retract, all the ladder-shaped blocks contact on external wall of the tube that has three holes through the tube wall to allow the three piston rods to move back and forth. Six hydraulic oil hoses of three hydraulic cylinders are connected to two main hydraulic pipes in parallel.

The hydraulic revolving device works with its external tube fixed to the bottom of the external position tube and a central positioning block connected to a steam spring. Positioned by a nut, the steam spring is coupled to the external tube wall of the cylinder of the revolving device through the shaft pin. The cylinder is coupled to a pressure stop dog by a revolving pin. A displacement sensor and the hydraulic oil hoses are fixed on the cylinder. The hydraulic oil hoses are extended through the tube wall. With the pressure stop dog and pressure shaft locked by the coupling shaft with a nut, revolution is performed with reciprocating movement of the cylinder.

The other way of operation of the hydraulic revolving device is with its external tube rigidly coupled to the positioning device, the cylinder positioning block coupled to the external tube wall, the cylinder coupled to the external tube and the cylinder positioning block, the cylinder piston rod connection rack engaged with a gear that is fastened on the external tube wall and shaft holding block with a first bevel gear by means of a shaft so as to engage with a second bevel gear coupled to a central shaft. With a pressure stop dog, the pressure bearing is revolved.

The unidirectional pulling type bi-directional cylinder has its upper lid of the bi-directional cylinder coupled to the central shaft. The bi-directional cylinder includes a cylinder wall, a piston pulling rod, a piston push sleeve, and hydraulic hoses. The piston pulling rod moves downward along the cylinder inside wall while the piston push sleeve allows a reciprocating movement along cylinder inner wall and the external wall of the piston pulling rod. With the control of hydraulic oil, the piston push sleeve is connected to a multi-arm connecting block with a revolving pin. The multi-arm connecting block is coupled to 3–4 bow pressing arms with the shaft pin and the bow pressing arms and a bottom support are rigidly coupled to the piston pulling rod. Displacement sensors are respectively fitted on the multi-arm connecting block and the piston pulling rod. Pressure sensors and the displacement sensors are connected to a single-chip processor fitted on the multi-arm connecting block.

The hydraulic expanding head is connected to the crane by a steel rope and connected with automatic hydraulic control center through multi-channel tube and the control circuit. The hydraulic control center includes a hydraulic plunger pump connected to a control keyboard, a printer, a display, a central processing display, a notebook respectively. The hydraulic control center is installed on a truck that has a diesel plunger pump to be able to switch with an electric plunger pump for operation.

The depth measuring system has its support plate connected to two shafts which are mounted on two wheels. These two wheels are connected to the steel rope of the crane with the support frame of the depth measuring system fixed on ground. One of the two wheels is slidible along a slot in the support plate. Lateral movement of the shaft is controlled by a spring which is connected to support plate and the shaft. At the other wheel, a light block device is mounted. A photo-electro interrupter is fitted on the support plate. These two wheels sandwich the steel rope when pulling one of the wheels backward, so as to turn the movement of the steel rope into rotation of the wheels. With one turn completed, the photo-electro interrupter is interrupted once by the light block device. The photo-electro interrupter counts the times of the interruption so that the depth that the hydraulic expanding head locates in a hole can be measured. The crane, expanding apparatus, and truck can be combined into one vehicle, i.e. putting the crane, expanding apparatus, depth measuring system, automatic control hydraulic center onto one truck for easy movement.

The positive effects of the present invention are as below:

(1) With the aid of the flexible steel rope, the lever force due to rigid connection is released, the steel tube segments for extended length of the hydraulic expanding head in a hole is reduced, and the total weight of the extended steel tube is lessened. Accordingly, the expanding apparatus in accordance with the present invention may be for wider applications.

(2) As the hydraulic automatic revolving device is adapted for transfer of torque, three cylinders are used for self-positioning of the revolving. Fitted 120° apart between any two of them on a horizontal, the ladder-shaped blocks are pushed into the soil on the wall of the hole when the hydraulic cylinders stretch out, positioning its center of the hydraulic expanding head body as the self-positioning is performed with the three cylinders' operation.

(3) The use of the bi-directional cylinder expanding device eliminates up or down movement of the equipment during the positioning operation, hence the soil drop to the bottom of the hole is greatly reduced. Compared to the prior art expanding apparatus, where the three points (referring to FIG. 1) on the three connecting shafts of its three bow pressing arms moved during operation as described below:

X and Y represent the horizontal or vertical directions of the force, arrows following X and Y indicate the direction of movements.

$$\text{Point A}\begin{cases} X = 0 \\ Y = \downarrow \end{cases} \quad \text{Point B}\begin{cases} X = \rightarrow \\ Y = \downarrow \end{cases} \quad \text{Point C}\begin{cases} X = 0 \\ Y = 0 \end{cases}$$

Such a movement causes a lot of dregs on the bottom of the hole. When point B just comes into contact with the soil, the hydraulic expanding head penetrates into soil not much, so the wall of the hole can hardly provide any support. The movement in Y direction at point B applies the weight of the hydraulic expanding head to point B, resulting in soil slide into the bottom as dregs. While the hydraulic expanding head is lowered to deep in the hole, it will be raised due to downwards movement of point B, for example, a hydraulic expanding head of ϕ600 mm goes up 30–40 cm with each expanding operation. If the left and right points become unbalanced during expanding operation, an offset from its raising direction, which in turn results in the hydraulic expanding head to be in contact with the hole wall to cause accident. Accordingly, movements of the three connecting shafts in accordance with the present invention are defined as following:

$$\text{Point A}\begin{cases} X = 0 \\ Y = \downarrow \end{cases} \quad \text{Point B}\begin{cases} X = \rightarrow \\ Y = 0 \end{cases} \quad \text{Point C}\begin{cases} X = 0 \\ Y = \downarrow \end{cases}$$

$|YA|=|YC|$ means these two sectors are of identical absolute values, but in opposite directions. Such shaft B only moves along X direction i.e. the expanding direction, the hydraulic expanding head completes expanding operation with point B as a fixed horizontal position without vertical movement, reducing drastically the amount of dregs down to the bottom of the hole. The piston sleeve and piston rod are pushed out at identical operation pressure and the working areas of the piston sleeve and piston rod are the same, so the force of both when pushing out is same as each other. On the other hand, when the cylinder retracts, the upper and lower cylinders are connected to each other with identical operation pressure but different working areas, resulting in different retracting speeds of them. However, the expanding apparatus does no work when retracting so that expanding operation may be performed smoothly.

The expanding apparatus in accordance with the present invention replaces the cylinder long rod pressure, i.e. the piston rod is compressed when doing work, by cylinder piston long rod pulling i.e. the piston rod is pulled when doing work, which greatly improves the effect of side-direction force on the piston rod, ensuring Point B to move only along X direction and less or no dropping of soil during expanding operation.

(4) As the expanding apparatus in accordance with the invention is designed an uni-directional pulling cylinder which clears up dregs and therefore greatly increases the efficiency to construct piles. Clear-up of dregs at the bottom of a hole is a most difficult problem prior art encountered. If the dregs can not be cleared up, the bearing capacity at the end of a pile may be affected seriously. In order to solve this problem, a pulling cylinder hydraulic expanding head in accordance with the present invention is designed to define movement of the three connecting shafts of the bow pressing arms as below:

$$\text{Point A}\begin{cases} X = 0 \\ Y = 0 \end{cases} \quad \text{Point B}\begin{cases} X = \rightarrow \\ Y = \downarrow \end{cases} \quad \text{Point C}\begin{cases} X = 0 \\ Y = \downarrow \end{cases}$$

As point B moves in Y direction, which enables the hydraulic expanding head has a Y↓ movement. In case of a cylinder of ϕ400 with a 200–300 tons of expanding force, the hydraulic expanding head expands downwards while expanding operation is performing on two sides. With the body of the hydraulic expanding head moving down by 30–40 cm, the dregs of soil at the bottom of the hole is compressed into solid status. It is proven that the bearing capacity of compressed soil is increased by 30%. This solved the dregs problem in operation of branch plate cavity expanding operation.

(5) As the hydraulic expanding head in accordance with the present invention eliminates the external tube, the multi-arm expanding head is prevented from interference of the external tube within identical circular cross section. The multi-arm hydraulic expanding head adopts inner positioning guide to replace the external positioning guide of prior art, which saves space greatly, causes drastic weight reduction, enables multi-arm expanding each time in identical circular cross section. i.e. expanding operation may be done once in an identical circular cross section with 3 arms, 4 arms, 6 arms, 8 arms, 12 arms, greatly enhancing efficiency, operation stability, and central positioning.

(6) The hydraulic expanding head in accordance with the present invention is automatically controlled with a pressure sensor installed by 0.618 of length on each bow pressing arm, so pressure values at any moment may be obtained during expanding operation. Pressure value that is varied with the time is amplified and converted into a digital signal by an A/D converter, and three curves are printed by an integraph and ΣF values are shown. Therefore, the pressure status of each arm reflects not only single force but also combined force to recognize soil layers for quality control during construction.

(7) With a displacement sensor and a single chip processor installed on the bow pressing arm, an overall model can be built up in a microprocessor during the operation, thus obtaining pressure value on each arm, value of pressed angle, value of revolving angle, and the depth of the expanding apparatus in the hole in real time, which can eventually give the load bearing capacity of each pile before it is poured, i.e. it is a test of the prospecting, also it is a solution in testing of the branch plate pile. For example, when an expanding operation is finished but the its quality is unknown, one more expanding operation can be carried out at the same position. The expanding operation is successful if the indication of the pressure meter does not change. Otherwise, the change of pressure value at an angle shows a collapse occurred there. When the power supply is off, a notebook PC may be used for data processing, enabling quality control of the construction and establishing a database for each pile for future design.

(8) With an automatic control hydraulic center and a diesel hydraulic station installed on a diesel truck, the hydraulic expanding head in accordance with the present invention can operate in fields using the diesel hydraulic station with insufficient power supply; otherwise, it can operate with electric hydraulic station to have the hydraulic expanding head in accordance with the present invention operate under various condition, especially in road and bridge construction.

These and other features and advantages of the present invention are apparent from the description below with reference to the following drawings.

BRIEF DESCRIPTION OF THE DRAWINGS

FIG. 4-1 is a section view of an automatic gear revolving device of the hydraulic expanding head in accordance with the present invention;

FIG. 4-2 is a top view of the hydraulic expanding head in accordance with the present invention;

FIG. 6-1 is a section view of a three bow pressing arm device of the hydraulic expanding head in accordance with the present invention;

FIG. 6-2 a section view of a four bow pressing arm device of the hydraulic expanding head in accordance with the present invention;

FIG. 8-1 is a front view of an electronic depth measuring system of the hydraulic expanding head in accordance with the present invention; and FIG. 8-2 is a top view of the electronic depth measuring system of the hydraulic expanding head in accordance with the present invention.

DESCRIPTION OF THE PREFERRED EMBODIMENTS

Figure 1:
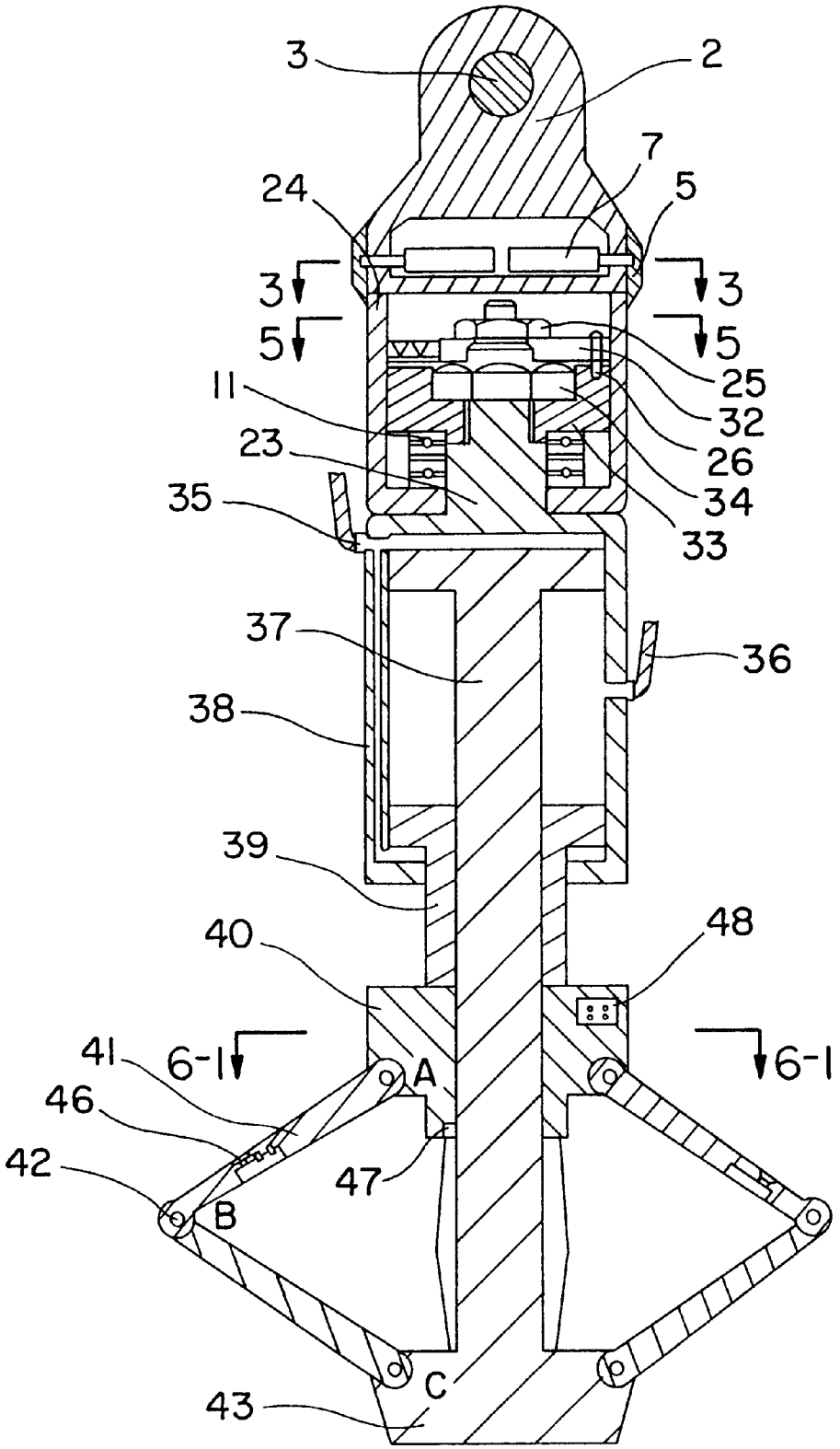
FIG. 1 is a section view of the hydraulic expanding head in accordance with the present invention.
Figure 3:
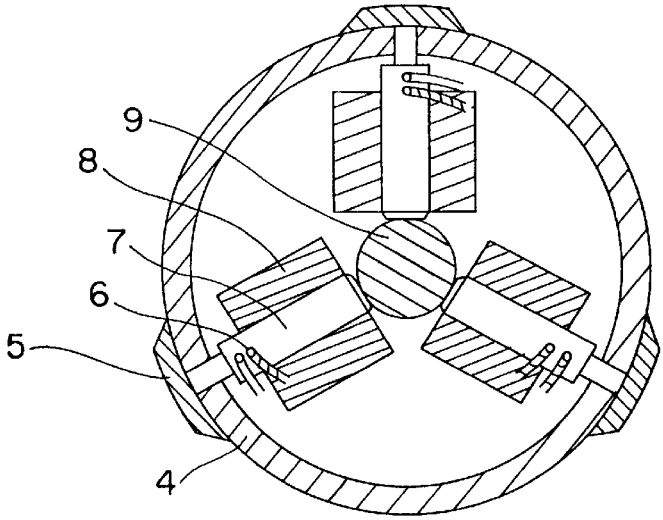
FIG. 3 is a section view of a revolving positioning of the hydraulic expanding head in accordance with the present invention.

A hydraulic expanding head of intelligent multi-functional hydraulic expanding apparatus in accordance with the present invention includes a coupling body 2, a shaft pin 3, an external tube 4, a ladder-shaped block 5, a hydraulic hose 6, a hydraulic cylinder 7, a positioning block 8, and a central positioning block 9, as shown in FIG. 1 and FIG. 3. A hook of a truck lifts up or down of the hydraulic expanding head through shaft pin 3. During operation, hydraulic cylinder 7 pushes ladder-shaped block 5 into soil to locate the position while ladder-shaped block 5 is pulled to be in contaact with external tube 4 when hydraulic cylinder 7 retracts.

Figure 5:
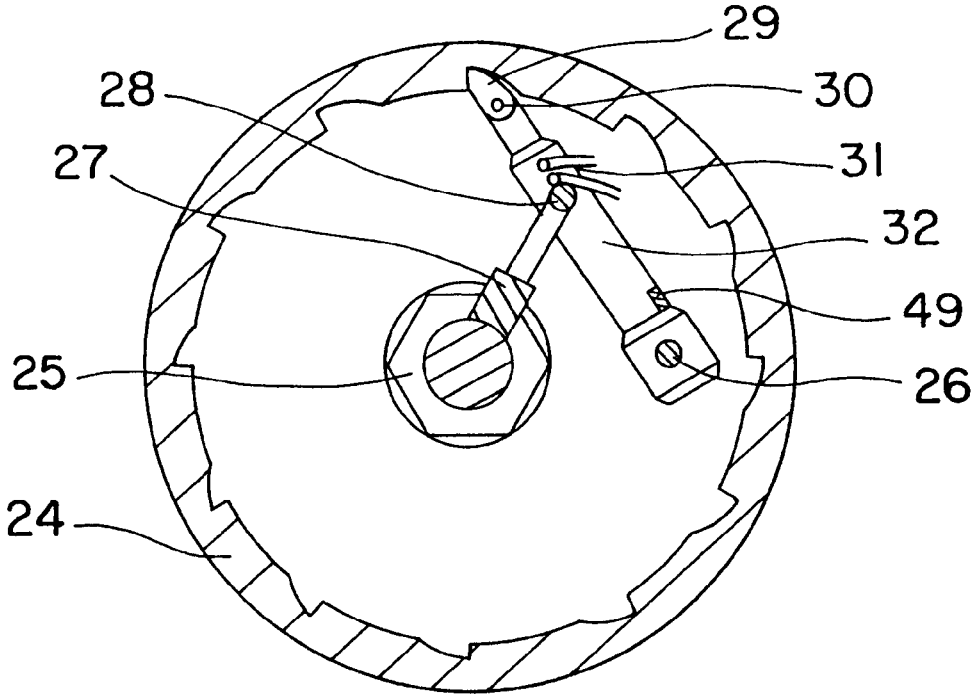
FIG. 5 is a section view of a cylinder revolving device of the hydraulic expanding head in accordance with the present invention.

Referring to FIG. 5 that is B—B section of FIG. 1, an automatic hydraulic revolving device includes an external tube 24, a nut 25, a revolving pin 26, a steam spring 27, a coupling shaft 28, a revolving push block 29, a pin 30, an oil hose 31, a hydraulic cylinder 32, a pressure stop dog 33, a nut 34, and a displacement sensor 49. With cylinder 32 stretches, revolving push block 29 makes external wall 24 revolve. When cylinder 32 retracts, steam spring 27 pushes cylinder 32 to make revolving push block 29 move backwards along the internal wall of external tube 24 to the next slot, revolving push block 29 enters into the slot and cylinder 32 stretches again to start next cycle. This operation repeats with revolution of 30° after each cycle. A sensor 49 generates a signal when the revolution of 30° is finished to implement automatic control.

Figure 2:
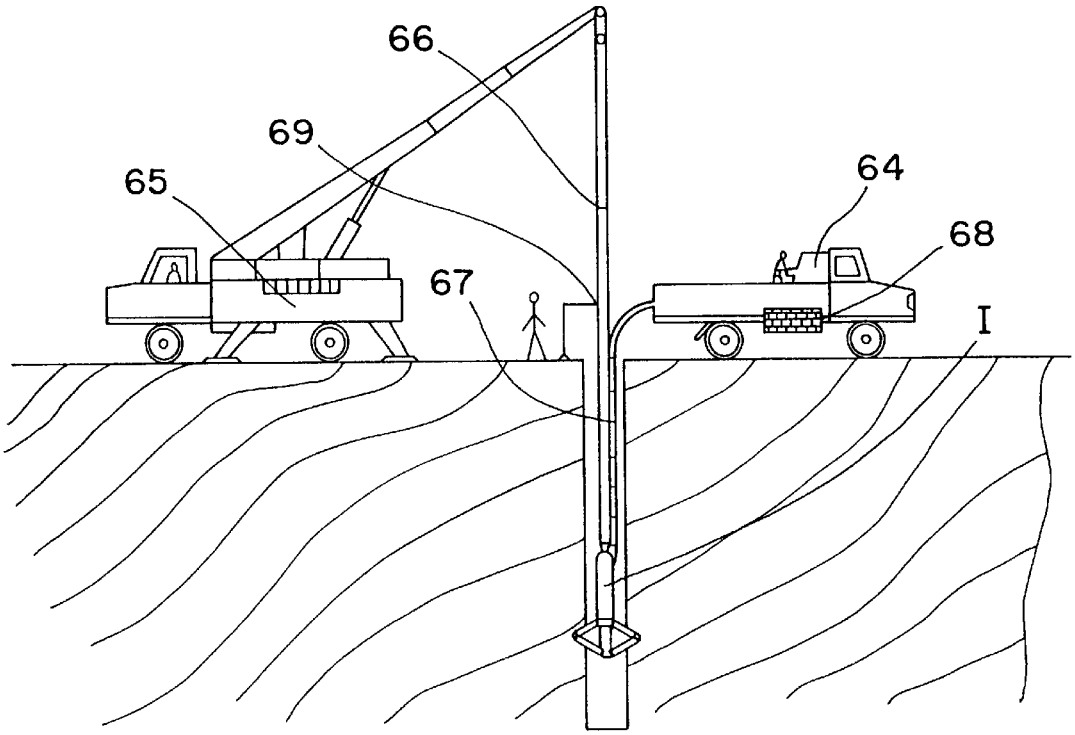
FIG. 2 shows the coupling of the expanding apparatus in accordance with the present invention in operation.
Figures 1, 4:
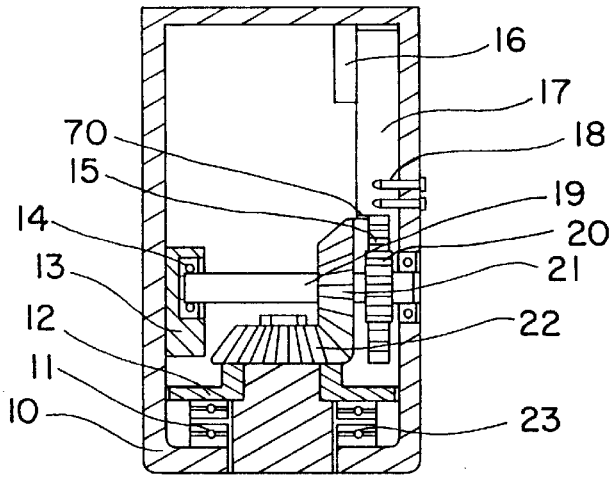
Figures 2, 4:
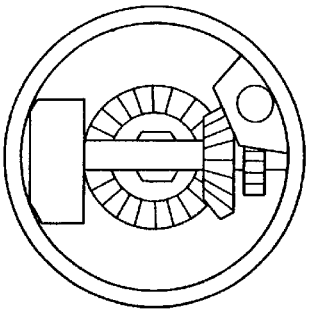

Alternatively, automatic hydraulic revolving device may be implemented as shown in FIGS. 4-1 and 4-2. The automatic hydraulic revolving device includes an external tube 10, a pressure bearing 11, a coupling pressure stop dog 12, a bearing support block 13, a bearing 14, a rack 15, a cylinder positioning block 16, a hydraulic cylinder 17, an oil hose 18, a gear axle 19, a spur gear 20, bevel gears 21 and 22, and a coupling shaft 23. Cylinder 17 drives rack 15 move up and down, which in turn drives spur gear 20 and bevel 22 rotated. The rotation of bevel 22 drives bevel 22 rotated, which then drive coupling shaft 23. Finally, the linear movement of cylinder 17 is turned into vertical rotation of rack 15.

Unidirectional pulling type bi-directional cylinder of hydraulic expanding head includes hoses 35 and 36, a piston rod 37, cylinder wall 38, and a piston sleeve 39. When oil is injected into the cylinder via hose 36, piston rod 37 and piston sleeve 39 do work. As the working areas of piston rod 37 and piston sleeve 39 are the same, their displacements are of a same distance but in opposite directions. Piston rod 37 and piston sleeve 39 retract in the cylinder when oil is injected into it from hose 35. The top and bottom of the cylinder are connected to perform a operation cycle of the bi-directional cylinder.

Unidirectional cylinder includes hoses 35 and 36, a piston rod 37, cylinder wall 38 without piston sleeve 39. Piston rod 37 coordinates with cylinder wall 38 so that piston rod 37 moves upwards when oil is injected into the cylinder from hose 36 while it moves downwards when oil is injected into the cylinder from hose 35.

Expanding arm of the hydraulic expanding head includes a multi-arm connecting block 40, a bow pressing arm 41, a shaft pin 42, a bottom support 43, a pressure sensor 46, a displacement sensor 47, and a micro-processor 48. Connecting block 40 moves down with piston sleeve 39. In the meantime bottom support 43 is brought upwards by piston rod 37. In this way bow pressing arm 41 is driven to expand. In an opposite process, bow pressing arm 41 retracts. When connecting block 40 moves downwards, displacement sensor 47 measures the working angle of bow pressing arm 41 on the basis of the displacement of piston rod 37. A signal is sent to micro-processor 48 for amplification and then, transferred to control center for further processing. Sensor 46 fitted on bow pressing arm 41 measures the pressure value of the soil applied onto the bow pressing arm 41 during operation and a signal so generated is sent to micro-processor 48 for amplification and then, transferred to the control center for further processing.

Figures 1, 6:
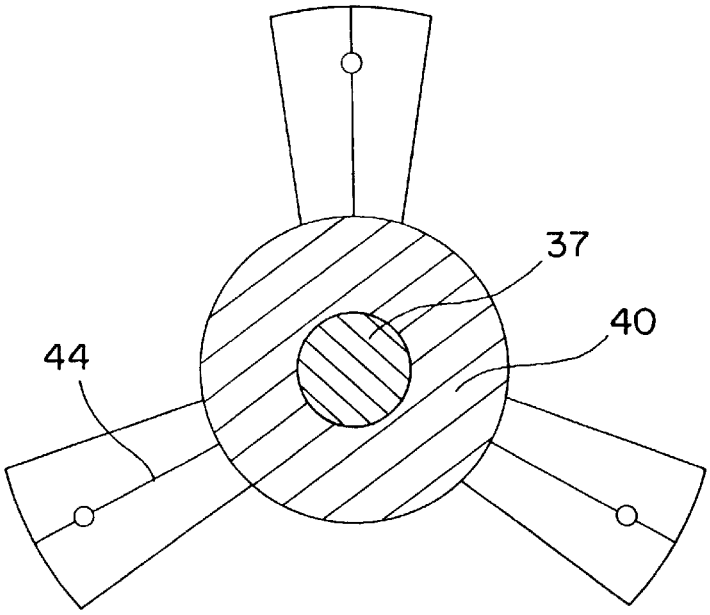
Figures 2, 6:
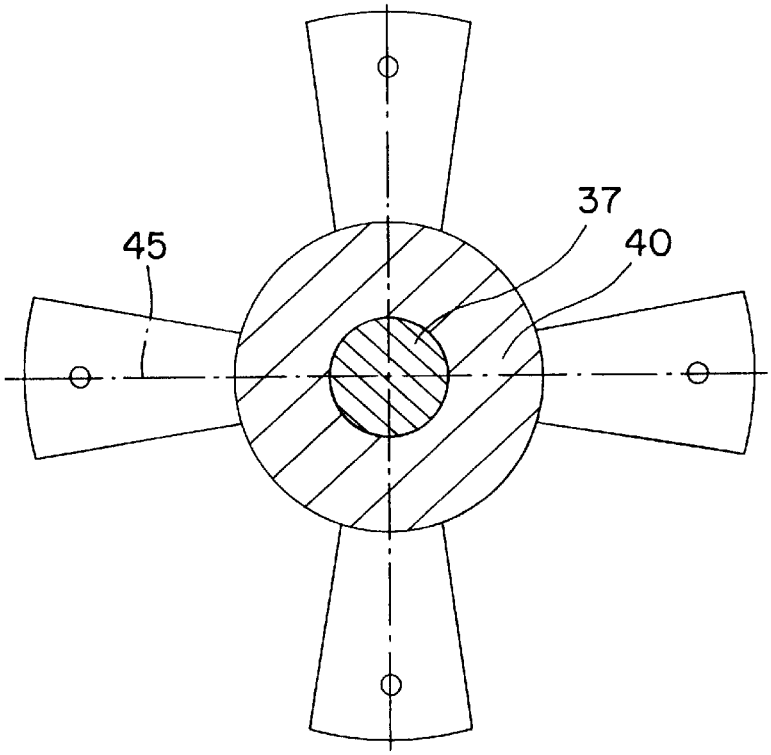

In accordance with one preferred embodiment of the present invention, multi-arm connecting block 40 outside piston rod 37 is connected to three bow pressing arm device 44 and bottom support 43, as shown in FIG. 6-1.

Alternatively, FIG. 6-2 shows another preferred embodiment of multi-arm expanding device in which multi-arm connecting block 40 outside piston rod 37 is connected to four bow pressing arm device 44 and bottom support 43.

Figures 1, 8:
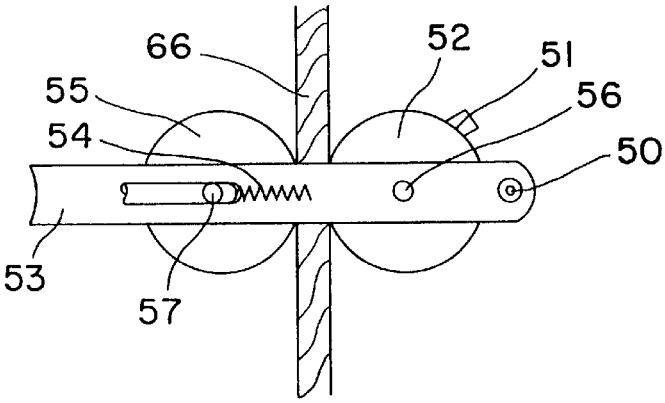
Figures 2, 8:
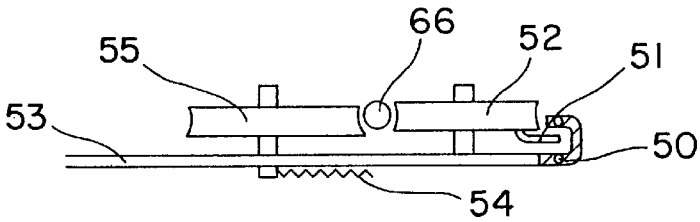

Depth measuring system includes a photo-electro interrupter 50, a light block device 51, a drive wheel 52, a holding plate 53, a spring 54, a wheel 55, and a shaft 56, as shown in FIGS. 8-1 and 8-2. In operation, wheel 55 is pulled backwards until steel rope 66 is clamped between two wheels. The movement of steel rope 66 brings wheels 52 and 55 rotated and when the light block device 51 is turned to a position where the photo-electro interrupter 50 is blocked, a pulse signal is generated by photo-electro interrupter 50 to indicate that the steel rope completes a cycle distance so that the depth of a hole is measured accurately.

Figure 7:
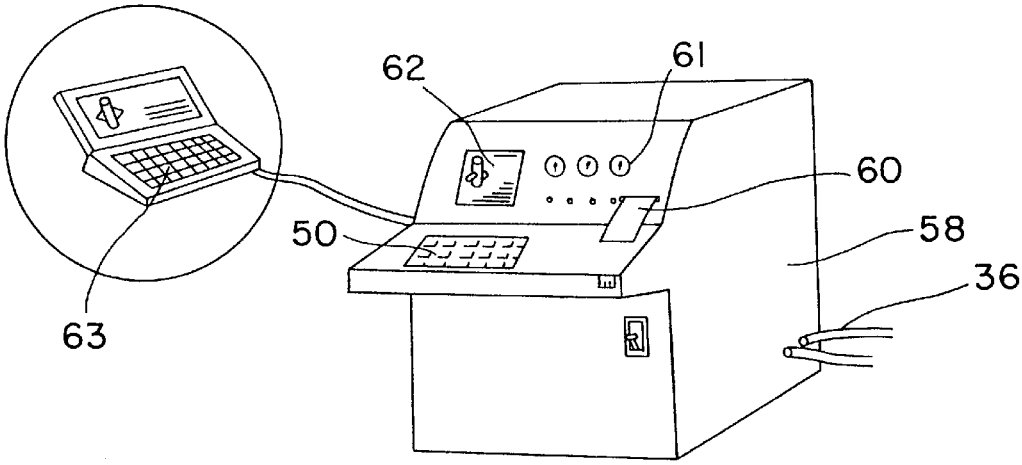
FIG. 7 is an illustrational view showing the automatic control hydraulic center of the hydraulic expanding head in accordance with the present invention.

An automatic control hydraulic center 64 includes hoses 35 and 36, a hydraulic plunger pump 58, a control keyboard 49, a printer 60, a meter 61, a microprocessor and display 62, and a notebook computer 63, as shown in FIG. 7. All data from microprocessor, pressure sensor, angle displacement sensor, and plunger pump is processed in the automatic control hydraulic center 64, which is based on in control of the operation of the expanding apparatus. Meanwhile, the data in all operation is recorded so as to display an overall three-dimensional model of the expanding apparatus in the microprocessor and display 62.

The couplings of the expanding apparatus in accordance with the present invention in operation is shown in FIG. 2. After a hole is drilled, crane 65 lifts hydraulic expanding head to lower it into the hole. The depth measuring system is fixed with a hose fastener 67 on the steel rope 66 and is lowered downwards into this hole slowly. When the depth measuring system reaches to a predetermined depth, automatic control hydraulic center 64 control the hydraulic expanding head to start to expand with expanding, retracting, revolving, and expanding of the bow pressing arms. This process repeats several times to form a branch plate cavity. Then the hydraulic expanding head is lowered to another predetermined depth and the operation is performed again to form another cavity. After the operation, the bow pressing arms are retracted and the hydraulic expanding head is lifted up by the crane. Followed processing is ire installation and concrete pouring to construct a branch plate pile. In the occasion of shortage of power, diesel plunger pump 68 is used, making the hydraulic expanding head is applied to wider range of operation conditions.

It will be understood that the previous descriptions and explanations are given by way of example, and that numerous changes in the combinations of elements and functions as well as changes in design may be made without departing from the spirit and scope of the invention as hereinafter claimed. These and other modifications to and variations upon the embodiments described above are provided for by the present invention, the scope of which is limited only by the following claims.

What is claimed is:

1. A hydraulic expanding apparatus for forming a side cavity in a hole comprising:

a hydraulic expanding head for forming said side cavity in the hole, said hydraulic expanding head having a plurality of bow pressing arms pivotably connected to a connecting block;

a hydraulic positioning device that locates the expanding apparatus at a desired position in the hole to form the side cavity; and a uni-directional pulling type bi-directional cylinder for controlling operation of the hydraulic expanding head;

a depth measuring system attached to said hydraulic expanding head that senses a depth at which the expanding head is positioned in the hole and that generates a signal corresponding to the depth;

an automatic hydraulic revolving device rigidly connected to said hydraulic positioning device so as to rotate the hydraulic revolving device in the hole at the desired position for forming the side cavity; and an automatic control hydraulic center that is located outside the hole and processes data transferred from said hydraulic expanding head.

2. A hydraulic expanding apparatus for forming a side cavity in a hole, the hydraulic expanding apparatus comprising:

a hydraulic expanding head that is lowered into the hole, the hydraulic expanding head having:

a plurality of bow pressing arms that are pivotably connected to a connecting block and are expanded to press against soil in the hole and form the side cavity when the hydraulic expanding head is operated;

a hydraulic positioning device that self-centers the apparatus at a desired location in the hole; and a uni-directional pulling-type bi-directional cylinder that controls the operation of the hydraulic expanding head;

a depth measuring system attached to the hydraulic expanding head that determines the depth at which the hydraulic expanding head is located in the hole;

an automatic hydraulic revolving device that rotates the hydraulic expanding head in the hole; and an automatic control hydraulic center that is located outside the hole and processes data transferred from the hydraulic expanding head.

3. A hydraulic expanding apparatus as recited in claim 2, wherein said hydraulic positioning device is connected with a coupling body and a shaft pin to a suspending rope, said coupling body is coupled to an external tube, and includes a plurality of positioning blocks and a central positioning block, each of which are fastened to the coupling body with a hydraulic cylinder, and at least one ladder-shaped block connecting to a piston rod of each respective hydraulic cylinder.

4. A hydraulic expanding apparatus as recited in claim 2, wherein said automatic hydraulic revolving device includes: an external tube connected to the bottom of the hydraulic positioning device, a central positioning block connected to a steam spring, the steam spring connected to the external tube, a cylinder connected to a pressure stop dog, a piston of the cylinder connected to a revolving push block, a displacement sensor and in and out hoses being fixed on the cylinder, said in and out hoses extending through two holes of the external tube, and a connecting shaft being coupled to a pressure stop dog and a pressure bearing.

5. A hydraulic expanding apparatus as recited in claim 2, wherein said automated hydraulic revolving device includes an external tube rigidly connected to the positioning device, a cylinder positioning block connected to the external tube, a cylinder connected to the external tube and the cylinder positioning block, and a cylinder piston rod connected to a rack and engaging a spur gear, the spur gear and a first bevel gear installed on bearing blocks, fastened on the external tube through a common shaft, the first bevel gear engaged with a second bevel gear on a central shaft and adapted for rotation.

6. A hydraulic expanding apparatus as recited in claim 2, wherein said uni-directional pulling type bi-directional cylinder is connected to a central shaft, a cylinder pull rod movable back and forth along an internal wall of the cylinder, a piston sleeve movable along the cylinder internal wall and an external wall of the cylinder pull rod, such that stretching and retracting of the cylinder is driven by in or out hoses, a piston sleeve connected to a plurality of bow pressing arms, each bow pressing arm rigidly connected to a bottom support and the piston pull rod, a pressure sensor is fitted on each bow pressing arm, and a displacement sensor is fitted on the multi-arm connecting block and the piston pull rod respectively, and the pressure sensor and displacement sensor are coupled to a processor fitted on the multi-arm connecting block.

7. A hydraulic expanding apparatus as recited in claim 2, wherein said automatic control hydraulic center includes a keyboard, a central process and display, and a computer, which are installed on a truck that is also furnished with a diesel plunger pump and an electric plunger pump for an alternative operation.

8. A hydraulic expanding apparatus as recited in claim 2, wherein said depth measuring system has its holding plate connected to two shafts fastended on two wheels respectively, the two wheels being coupled to a steel rope from the truck, the support frame of said depth measurement system being mounted on the ground, a first wheel of the two wheels being able to slide along a slot on the holding plate under control of a spring connected to the holding plate and the shaft, a light block device being fitted on a second wheel, a photo-detector interrupter fitted on the support plate, the steel rope being put through between the first and second wheels by pulling the sliding wheel apart, converting the linear movement of the steel rope into rotation of the wheels, the photo-electro interrupter counting once after each turn of the wheel so that the depth of the expanding head in the hole is measured on the basis of the number of counts.

* * * * *